United States Patent [19]

Colombier et al.

[11] Patent Number: 5,015,340

[45] Date of Patent: May 14, 1991

[54] METHOD OF CONTINUOUS COATING OF ELECTRICALLY CONDUCTIVE SUBSTRATES

[75] Inventors: Gabriel Colombier, Saint Egreve; Jacques Lefebvre, Voiron; Jean Galand, Villebon/S/Yvette; Armand Golay, Moirans, all of France

[73] Assignee: Aluminium Pechiney, Paris, France

[21] Appl. No.: 509,190

[22] Filed: Apr. 16, 1990

[30] Foreign Application Priority Data

Apr. 25, 1989 [FR] France ..... 89 06137

[51] Int. Cl.[5] ..... C25D 7/06

[52] U.S. Cl. ..... 204/28

[58] Field of Search ..... 204/28

[56] References Cited

U.S. PATENT DOCUMENTS 2,370,973 3/1945 Lang ..... 204/28

3,007,854 11/1961 Smith ..... 204/28

*Primary Examiner*—T. M. Tufariello

*Attorney, Agent, or Firm*—Dennison, Meserole, Pollack & Scheiner

[57] ABSTRACT

The invention relates to a method of continuously coating electrically conductive substrates using high-speed electrolysis in which the substrate is immersed successively in an electrolytic activating bath and an electrolytic coating bath. The two baths are of the same composition and the substrate is constantly maintained in one bath. The method is applicable especially to the nickel plating of fine aluminum wires intended for the production of flexible cable for aeronautical applications. These wires may be treated in layers and at high speed.

7 Claims, 2 Drawing Sheets

METHOD OF CONTINUOUS COATING OF ELECTRICALLY CONDUCTIVE SUBSTRATES

The present invention relates to a method of and an apparatus for the continuous coating of electrically conductive substrates by the use of high-speed electrolysis.

In this instance, the term substrate is understood as being any product which takes the form of a round, bar, tube, flat or strip of considerable length and in particular wire; the said substrates may consist of a material which is conductive of electricity, such as graphite, metals and more particularly aluminium and its alloys.

With regard to the coating, this may be any coating which covers the substrate in a continuous manner even to a minimal thickness and which offers suitable adhesion to withstand handling and stresses such as friction or clamping.

But of more particular interest here is the nickel plating of relatively fine aluminium wires intended to be used as electrical conductors in the production of flexible cables. This coating is obtained by electrolysis in which deposition takes place at high speed.

Among the documents representing the prior art in this field, it is possible to mention U.S. Pat. No. 4,097,342 which describes a method of producing aluminium members such as wire or strip which comprises passing the member continuously through a bath which has a high capacity for dissolving alumina, such as that formed by a solution of sulphuric acid and concentrated phosphoric acid and then through an electrolytic coating bath, the first bath being provided with a cathode in order to render the member anodic and the coating bath which is fitted with an anode.

This method may be used for coating aluminium with brass, zinc, lead, nickel or copper, coating baths of a suitable composition being employed. Thus, for example, in the case of tin, the bath consists of 300 g/l Sn $(BF_4)_2$, 200 g/l $HBF_4$, 25 g/l $H_3BO_3$, 30 g/l gelatin and 1 g/l $\beta$-naphthol. If the first process is applied to an aluminium wire with a diameter of 3.2 mm in a bath at 35° C. in which the wire is maintained for 5 seconds under a current density of 100 to 120 A/sq.dm, a thickness of tin of 5 $\mu$m is obtained, with a rate of travel of 36 m/min through baths 3 m in length.

In the same field, it is likewise possible to cite two other American patents which belong to the Applicants:

U.S. Pat. No. 4,492,615 which teaches the coating of a very long metal member with nickel and in which the member passes successively through a stripping die and then through a bath referred to as a "liquid connector" in which a cathode is immersed and finally through an electrolytic nickel plating bath, the passage from one bath to another possibly being via a phase in which the members are rinsed. In this method, the liquid connection may, for example, consist of a bath containing 125 g/l $NiCl_2$, 6 $H_2O$; 12.5 g/l $H_3BO_3$ and 6 cc/l of HF, while the coating bath consists of 300 g/l Ni $(NH_2SO_3)_2$ (sulphamate), 30 g/l $NiCl_2$, 6 $H_2O$ and 30 g/l $H_3BO_3$. These baths are used at respective temperatures of 40° and 65° C. in order to achieve equivalent resistivity levels.

Under these conditions, aluminium wire of 1.78 mm diameter has been successfully coated with a thickness of 1 $\mu$m of nickel using current densities of 175 A/sq.dm with rates of travel which may be as much as 300 m/min.

U.S. Pat. No. 4,741,811 relates to a nickel plating process based on the same principle as that in the above-mentioned patent, comprising an activating bath and a coating bath having the same compositions as hereinabove but in which the current density is modulated so that it can at the same time be applied to several wires of relatively small diameter, of around 0.51 mm to 0.15 mm. Thus it is possible to exceed a thickness of 1.5 $\mu$m of nickel with speeds of passage which are between 25 and 50 m/min.

All three of the documents quoted employ a method comprising an anodic pickling stage followed by a cathodic coating stage. The baths used for carrying out these stages always differ from one to another, which generally makes it necessary to carry out an intermediate rinsing stage in order to avoid the baths mixing. Furthermore, the point at which the wires pass through the facing walls of the tanks containing the baths are not absolutely fluid-tight and screening means will generally be provided to recover any entrained bath material, prior to rinsing, in order that it can be recycled. Such screening means are generally empty chambers in which the product is in contact with ambient air. As the densities of current which pass through the product between the two tanks are those of the main current and since they may attain very high levels of around 700 A/sq.mm cross-section, the consequence of the JOULE'S effect is a quite considerable release of heat.

It is obvious that this heat which is naturally dissipated through the liquid mass in each of the baths may not be so dissipated in the screening means and the result is excessive heating which may give rise to deformation or even breakage when the product consists of fine wires.

To avoid this phenomenon, it is necessary to reduce the intensity which passes through the wire while maintaining high passage speeds in order to minimise the time of exposure to the free air, which restricts the thickness of the coating.

Well, it is known that for a constant speed of travel, the relationship is:

$$e_{max} = \frac{K1\ I\ \max}{S} = \frac{K'I\ \max}{\phi}$$

and $I\ \max = K_2\phi^2$ in which e max = maximum thickness of the coating

I max = strength acceptable by the wires at a given speed $\phi$ = diameter of the wires.

Therefore $e\ \max = K'_1 \cdot K_2 \cdot \phi$.

Consequently, the smaller the diameter of the wires, the more reduced are the maximum thicknesses of coating which can be deposited on them.

Thus, when it is desired to deposit a sufficient thickness of coating on a fine wire, it will be necessary to provide for a relatively slow speed of passage which results in a relatively long period of exposure to the air and hence an increased risk of breakage.

It is to avoid this drawback due to the products having to pass outside a liquid bath for cooling that the Applicants have perfected a method for the continuous coating of at least one electrically conductive substrate by high-speed electrolysis in which the substrate passes successively through an activating bath into which at least one cathode is plunged and then through a coating bath into which at least one anode is plunged, characterised in that the said baths are identical in composition.

It is obvious that under these conditions it is possible to dispense with intermediate rinsing and hence recovery of bath and consequently the substrate can be kept constantly submerged in a liquid so that any heating is avoided. Consequently, it becomes possible to increase the current densities and to carry out coating of fine wires.

Preferably, these baths circulate in relation to the electrodes in the same direction or in the opposite direction to that of the substrate in order to ensure a better heat exchange. Thus, one has a common bath which is shared into two portions, each being capable of being heated or cooled at will and propelled to the points of use and then returned to a common collecting point where they can be likewise subjected to heat or cleansing treatments.

Furthermore, in order to optimise the method so that, if necessary, activating and coating baths can be made to operate at different temperatures, the substrate may be passed between the two baths through a buffer bath of the same composition as the other two.

In this case, it is likewise preferable to ensure circulation of the said bath which may be carried out in the form of a third portion taken from the common bath and possibly subjected to heat treatments and to specific conditions of movement.

Another function of this buffer bath is to avoid having the substrates pass suddenly from anodic polarity to cathodic polarity, so enjoying a progressive variation from the activating bath current to the coating bath current so that optimum electrical conditions for coating are provided immediately the substrate enters the bath.

More particularly in the case of nickel plating, the single bath employed is a mixture having the following composition:

nickel sulphamate which makes it possible to obtain deposits exhibiting the qualities required in a very high density current, nickel chloride which acts as an electrode depassivator, nickel fluoroborate which, at the activation stage, makes it possible to obtain a very fine attack on the substrate so creating a vast number of nickel germination sites and therefore a much finer deposit than that created on the germination sites obtained with the nickel chloride bath described in the Applicants' abovementioned patents, fluoroboric acid which makes it possible to regulate the pH of the bath at between 1.5 and 3, possibly orthoboric acid, the function of which is to buffer the solution on the surfaces which are subject to electrochemical reactions.

In the case of substrates in the form of fine wires, by avoiding exposure to the air, the method according to the invention has the advantage that it is possible to multiply the maximum admissible current strengths by a factor of 4.

Thus, for example, an aluminium wire of type 1310-50 to the Standards of the Aluminium Association and having a diameter of 12/100 would melt under a current strength of 8 A according to the prior art techniques, which made it necessary to restrict the speed of passage to 32 m/min in order to obtain a 1 μm nickel coating under a current strength of 6 A.

With the method according to the invention, the same wire is capable of withstanding a 24 A current without breaking, which makes it possible to nickel plate at speeds of around 130 m/min in an installation, the electrolytic part of which does not exceed 2.5 m in length.

Furthermore, the diameter of the nickel nodules obtained is far smaller than in the prior art, which results in a better rate of coverage of the wire. Similarly, the contact resistance measured by the crossed wires method yields values below 500 g of loading of between 0.2 and 0.7 mΩ whereas in U.S. Pat. No. 4,741,811 these levels were between 1.5 and 2 mΩ.

Finally, thanks to the greater fineness of the deposit, the nickel lends itself well to subjacent deformation of the substrate. Indeed, the adhesion test which consists of rolling up the nickel plated wire on its own diameter shows that the nickel film is able perfectly well to follow the deformation without becoming detached.

The invention likewise relates to an apparatus which applies the method according to the invention, which is characterised in that it is formed by a tank separated into two compartments by a partition of electrically insulating material containing the baths of identical composition into which are plunged at least one electrode connected to the positive pole of a current source at least in the continuous part, while into the other is plunged an electrode connected to the negative pole of the same source, the said compartments and the partition each being provided with inlet and outlet pipes each connected by a tank for a pumped supply and a heat exchanger and being traversed on either side while the partition is traversed by at least one fluid-tight aperture through which passes the substrate which is to be coated.

Thus, the apparatus differs from that of the prior art represented by U.S. Pat. No. 4,492,615 by the absence of a space between the "liquid connection" compartment or activating compartment and the coating compartment, in order to avoid any contact between the substrate and the air and in order to ensure continuous cooling via the bath.

This tank is of preferably parallelepiped form having a vertically disposed partition which divides it into two compartments each of which is about 1 m long. The walls of the tank which are parallel with this partition and the said partition are provided with a plurality of apertures which are so disposed that it is possible to pass a sheet of wires, for example at suitable intervals, for them to enjoy the very best electrical processing conditions. The dimensions of the apertures are such as are needed to obtain satisfactory sealing-tightness in respect of the tank so that any loss of bath material is avoided.

In order to overcome the considerable variation in polarity resulting from passage of the wire from one compartment to the other, the Applicants likewise propose an alternative form of apparatus characterised in that it consists of a tank separated into three compartments by two partitions of electrically insulating material and containing baths of identical composition, one of the end compartments being equipped with at least one electrode which plunges into the bath and which is connected to the positive pole of a current source at least in the continuous part while the other is equipped with at least one electrode plunging into the bath and connected to the negative pole of the same current source, the said compartments being each provided with a bath inlet and outlet pipe each connected to a supply tank via a pump and a heat exchanger and being traversed on either side by at least one fluid-tight aperture through which passes the substrate which is to be coated.

Therefore, this alternative embodiment resides in incorporating between the two compartments of the above-mentioned apparatus as buffer compartment containing the same bath as the other two.

All these compartments are connected to a common supply tank through two pipes in order to form circuits which may be partly independent and into which the bath may be conveyed, passing through heat exchange and purification appliances.

With regard to the intermediate compartment, it must be sufficiently long to ensure a progressive change in polarity. Preferably, this length is between 50 and 200 mm.

The apparatus according to the invention will be more clearly understood from the attached drawings, which show in a very diagrammatic fashion:

in FIG. 1, a vertical section through the apparatus with two compartments in FIG. 2, the same view of an apparatus comprising three compartments.

In addition:

Figure 1:
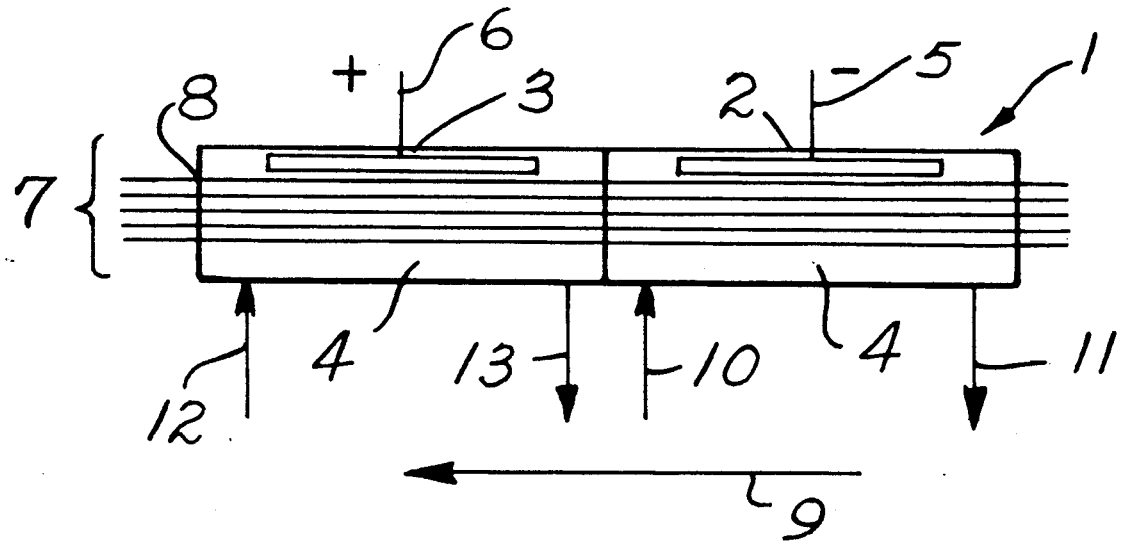

FIG. 1 shows a tank 1 consisting of an activating compartment 2 and a coating compartment 3 containing a bath 4 and into which are respectively immersed a cathode 5 and an anode 6. This tank is traversed by a layer of five wires 7 passing through apertures 8 in the direction of travel 9. Each of the compartments is connected to a supply tank, not shown, by respective pipes 10–11 and 12–13.

Figure 2:
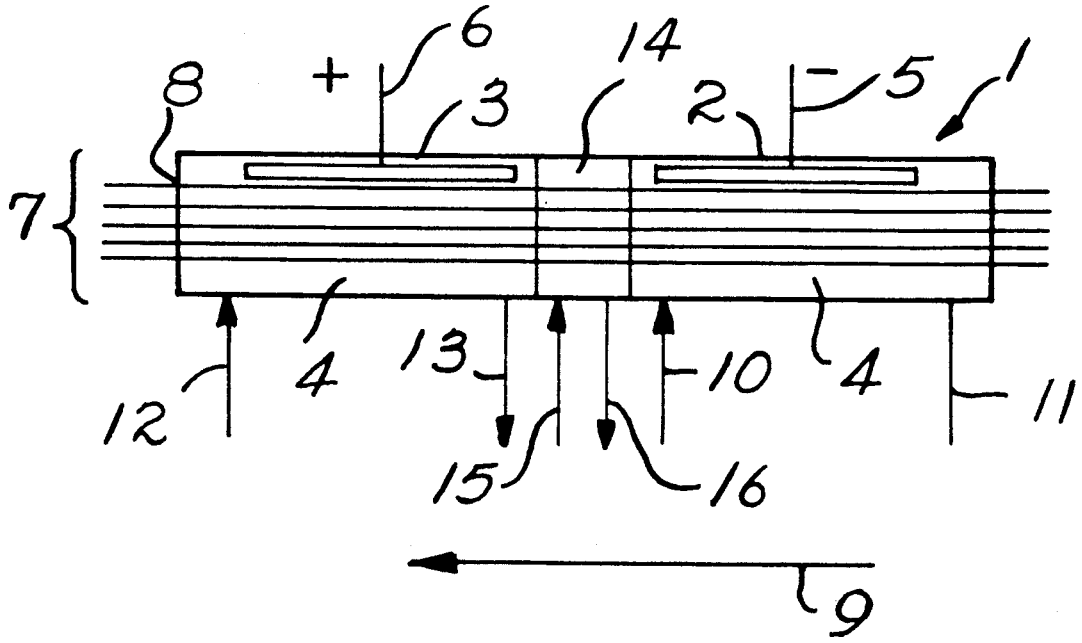

The same elements as in FIG. 1 can also be found in FIG. 2 and to them is added the compartment 14 which is fitted with pipes 15 and 16.

The invention may be illustrated by means of the following examples of application:

EXAMPLE 1

An aluminium wire of type 1310.50 according to the Standards of the Aluminium Association, with a diameter of 0.12 mm, was activated and then nickel plated in a bath having the following chemical composition:

| | |
|---|---|
| 50% nickel sulphamate | 330 cc/l |
| nickel fluoborate | 55 cc/l |
| 50% fluoboric acid | 5 cc/l |
| nickel chloride | 21 g/l |
| orthoboric acid | 16 g/l |

ph of the bath—1.6
temperature—60° for the two compartments
graphite plates in the activating compartment
nickel electrodes in the nickel plating compartment.

The two compartments were separated by a single partition.

| Speed m/min | Current strength A | Results: Voltage V | Thickness Ni (um) | Potential mV* |
|---|---|---|---|---|
| 32 | 6 | 10.5 | 1.00 | 400 |
| 45 | 9 | 17 | 1.07 | 460 |

-continued

| Speed m/min | Current strength A | Results: Voltage V | Thickness Ni (um) | Potential mV* |
|---|---|---|---|---|
| 62 | 12 | 22 | 1.03 | 480 |
| 80 | 15 | 28 | 1.00 | 540 |
| 100 | 19 | 35.5 | 1.01 | 600 |
| 133 | 24 | 46** | 0.96 | 700 |

*measured according to U.S. Pat. No. 4741811
**maximum voltage of the rectifier

No breakage was found which could be attributed to overheating of the wire.

These results should be compared with those obtained when using different activating and nickel plating baths with intermediate rinsing and passage through compressed air screening devices, conditions in which the 0.12 mm diameter wire melts at 8 A.

Figure 3:
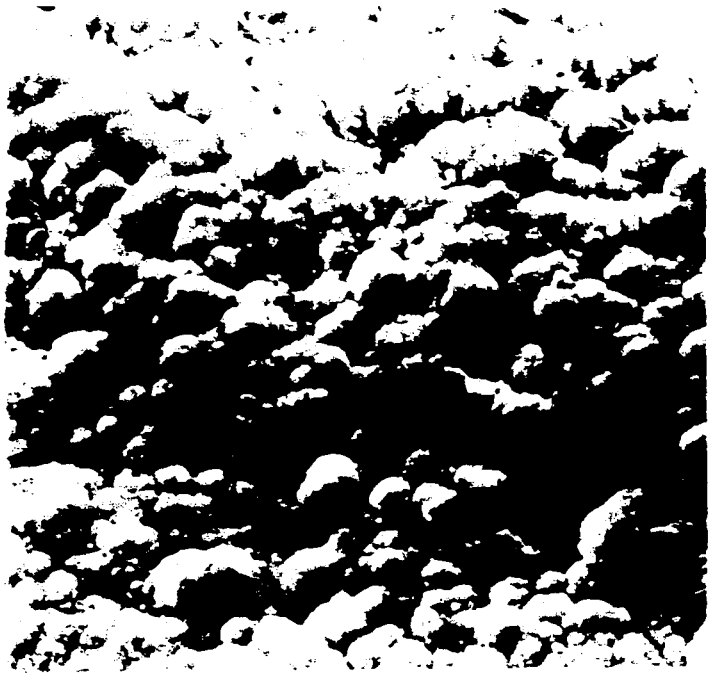
FIG. 3 is a photomicrograph of a coating according to the invention.
Figure 4:
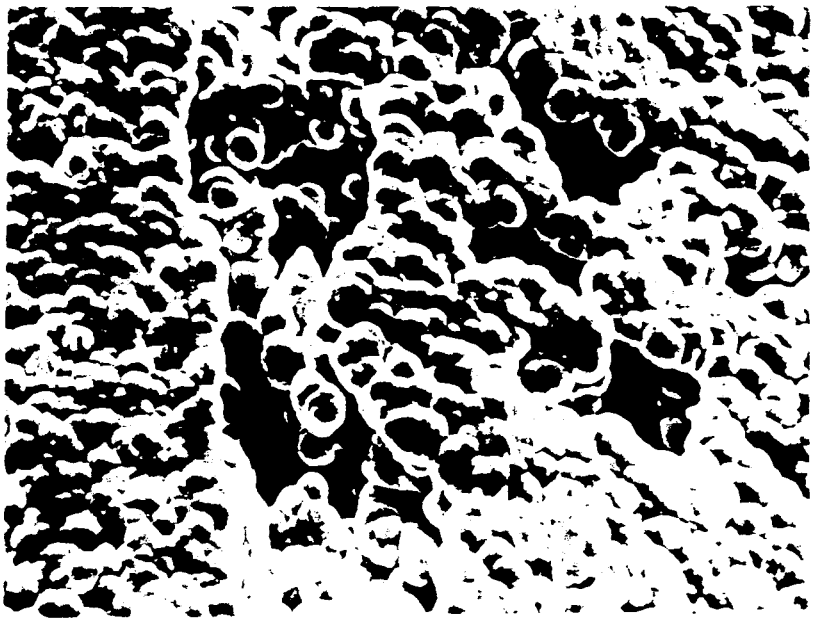
FIG. 4 is a photomicrograph of a prior art coating.

Characteristics of the wires obtained:

excellent adhesion of the nickel contact resistance (mΩ) under a load of 500 g: 0.19–0.-15–0.28–0.24, microscopic scanning inspection: FIG. 3 shows an excellent level of deposited nickel coating with nodules which are less pronounced than those obtained by the prior art (FIG. 4) but which are clearly smaller than 1 μm.

EXAMPLE 2

Four wires with a diameter of 0.15 mm were treated at the same time in a vertical layer in the bath described hereinabove in Example 1. The activating compartment was at a temperature of 45° C. while the nickel plating compartment was at a temperature of 60° C. Circulating in the central compartment was bath liquid which had been drawn off and discharged into the storage tank from the activating tank.

| Speed m/min | Current strength A | Results: Voltage V | Thickness Ni (um) | Potential mV* |
|---|---|---|---|---|
| 30 | 37 | 16 | 1.32 | 430 |
| 60 | 74 | 33 | 1.32 | 450 |
| 90 | 100 | 46** | 1.07 | 540 |

*measured according to U.S. Pat. No. 4741811
**maximum voltage of the rectifier characteristics of the wires:

excellent adhesion of the nickel contact resistance is comprised between 0.20 and 0.33 mΩ under a 500 g loading.

The invention can be applied particularly to the nickel plating of fine aluminium wires intended for the production of flexible cables for aeronautical applications. These fils can be treated in layers and at high speed.

What is claimed is:

1. A method of continuously coating at least one electrically conductive substrate of aluminium or copper with a metal of a different type by high-speed electrolysis comprising the steps of passing said substrate through an activating bath in which is immersed at least one cathode, subsequently passing said substrate through a buffer bath, and then passing said substrate through a coating bath in which is immersed at least one anode, wherein said baths are of identical composition.

2. A method according to claim 1, wherein the baths are caused to circulate in relation to the electrodes.

3. A method according to claim 1, wherein the buffer bath is caused to circulate.

4. A method according to claim 1, wherein a nickel coating is deposited, the common bath being composed of a mixture of nickel sulphamate, nickel fluoroborate, nickel chloride and fluoroboric acid.

5. A method according to claim 4, wherein the bath further comprises orthoboric acid.

6. The method according to claim 1, wherein there is provided a tank separated into three compartments by two partitions of electrically insulating material containing the baths which are of identical composition, providing one of the end compartments with at least one electrode which is immersed into the bath and which is connected to the positive pole of a current source and providing the other end tank with at least one electrode which is immersed into the bath and which is connected to the negative pole of the same current source, providing each compartment with pipes for the supply and discharge of bath liquid, connecting each compartment to a supply tank through a pump and heat exchanger and providing each compartment with at least one fluid-tight aperture through which is passed the substrate being coated.

7. The method according to claim 6, including providing an intermediate compartment of a length between 50 and 200 mm.

* * * * *